US006094752A

United States Patent [19]

Loshaw

[11] Patent Number: 6,094,752

[45] Date of Patent: Aug. 1, 2000

[54] PLATFORM ASSEMBLY FOR ELEVATING A TOILET

[76] Inventor: Harold B. Loshaw, 3471 Monte Carlo Dr., Las Vegas, Nev. 89121

[21] Appl. No.: 09/295,669

[22] Filed: Apr. 21, 1999

[51] Int. Cl.[7] ..... E03D 11/00

[52] U.S. Cl. ..... 4/252.1; 4/254

[58] Field of Search ..... 4/252.1, 232.4, 4/252.5, 254; 285/56, 57, 58, 59, 60; 108/65, 69, 90, 158.12, 26

[56] References Cited

U.S. PATENT DOCUMENTS

| | | | |
|---|---|---|---|
| 2,758,316 | 8/1956 | Schwarz et al. . | |
| 3,360,805 | 1/1968 | Aumann . | |
| 3,457,571 | 7/1969 | Harbeke | 4/420 |
| 3,967,836 | 7/1976 | Izzi, Sr. . | |
| 4,052,759 | 10/1977 | Hill . | |
| 4,648,139 | 3/1987 | Stokes . | |
| 4,726,079 | 2/1988 | Signori et al. . | |
| 4,794,653 | 1/1989 | Strasser . | |
| 4,886,302 | 12/1989 | Forbes . | |
| 5,031,251 | 7/1991 | Williams et al. . | |
| 5,303,430 | 4/1994 | Fernie et al. | 4/254 |
| 5,309,579 | 5/1994 | Nelson | 4/252.1 |
| 5,377,361 | 1/1995 | Piskula . | |
| 5,432,957 | 7/1995 | Fernie et al. . | |
| 5,628,257 | 5/1997 | Conner et al. | 108/153 |

*Primary Examiner*—Henry J. Recla
*Assistant Examiner*—Peter deVore
*Attorney, Agent, or Firm*—Kenneth L Tolar

[57] ABSTRACT

A platform assembly for elevating a conventional toilet includes a base platform section having a substantially rectangular opening for receiving an insert platform section. Both the insert and base platform sections include a plurality of extensions removably attached thereto allowing the size of the sections to be varied according to the size of a toilet and the orientation of the toilet outlet piping. The insert section includes a centrally located bore and an annular recess on its lower portion for receiving a flange on a bathroom floor. The upper surface of the insert section includes a second flange for providing a liquid tight seal between the insert section and the toilet. The toilet is mounted to the upper surface of the platform assembly thereby elevating the toilet for handicapped or elderly persons.

6 Claims, 1 Drawing Sheet

PLATFORM ASSEMBLY FOR ELEVATING A TOILET

BACKGROUND OF THE INVENTION

The present invention relates to a platform assembly for elevating a toilet.

DESCRIPTION OF THE PRIOR ART

Toilets designed for the handicap are often higher than conventional toilets and may include a thick toilet seat which is unsightly. Furthermore, the higher toilets are inconvenient for children or those who are not handicapped. Accordingly, there is currently a need for a device that provides an unsightly means for elevating the height of a conventional toilet seat. Although various platforms exist for elevating a toilet, they are not adapted to be used with various toilet sizes and configurations according to the present invention. For example, U.S. Pat. No. 5,432,957 issued to Fernie relates to a base on which a toilet may be mounted to elevate the toilet a predetermined distance. A soil pipe extension is mountable to select locations along an opening on the base depending upon the size of the toilet.

U.S. Pat. No. 4,648,139 issued to Stokes relates to a mounting ring assembly for a toilet bowl.

U.S. Pat. No. 4,052,759 issued to Hill relates to a floor-mounted anchor unit for toilets.

U.S. Pat. No. 3,967,836 issued to Izzi, Sr. relates to an offset plastic flange for connecting toilet bowls to drain pipes.

U.S. Pat. No. 2,758,316 issued to Schwarz et al relates to a sanitary base for flush toilets.

The present invention overcomes disadvantages associated with prior art elevating platforms by providing a base platform section having an insert platform section removably received therein. Each platform section includes a plurality of interlocking extensions allowing the length of the platforms to be adjusted to fit various size toilets regardless of the orientation of the toilet outlet piping.

SUMMARY OF THE INVENTION

The present invention relates to a platform assembly for elevating a toilet. The device comprises a base platform section including an upper surface, a lower surface and a substantially rectangular opening. The base platform section includes a plurality of removable extensions allowing the length of the base platform to be varied depending upon the size of the toilet. An insert platform section is received within the opening on the base platform section. The insert section also includes a plurality of extensions whereby the length may be varied. A bore extends from the upper surface to the lower surface of the insert section to establish fluid communication between the toilet outlet and a sewer line. On the lower surface of the insert section surrounding the bore is a recess for receiving the existing flange on the bathroom floor. On the upper surface of the insert section surrounding the opposing end of the bore is a flange with a wax ring mounted thereon. The flange includes a pair of diametrically opposed apertures for receiving floor mounted bolts to secure a toilet and the insert platform section to the floor. Accordingly, an existing toilet may be mounted on the platform assembly to elevate the toilet a predetermined distance above the bathroom floor. It is therefore an object of the present invention to provide a device that elevates an existing toilet a predetermined distance above the ground.

It is another object of the present invention to provide a device for elevating an existing toilet which may be selectively configured to elevate varying size toilets.

It is yet another object of the present invention to provide a device for elevating a conventional toilet that may be easily installed. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
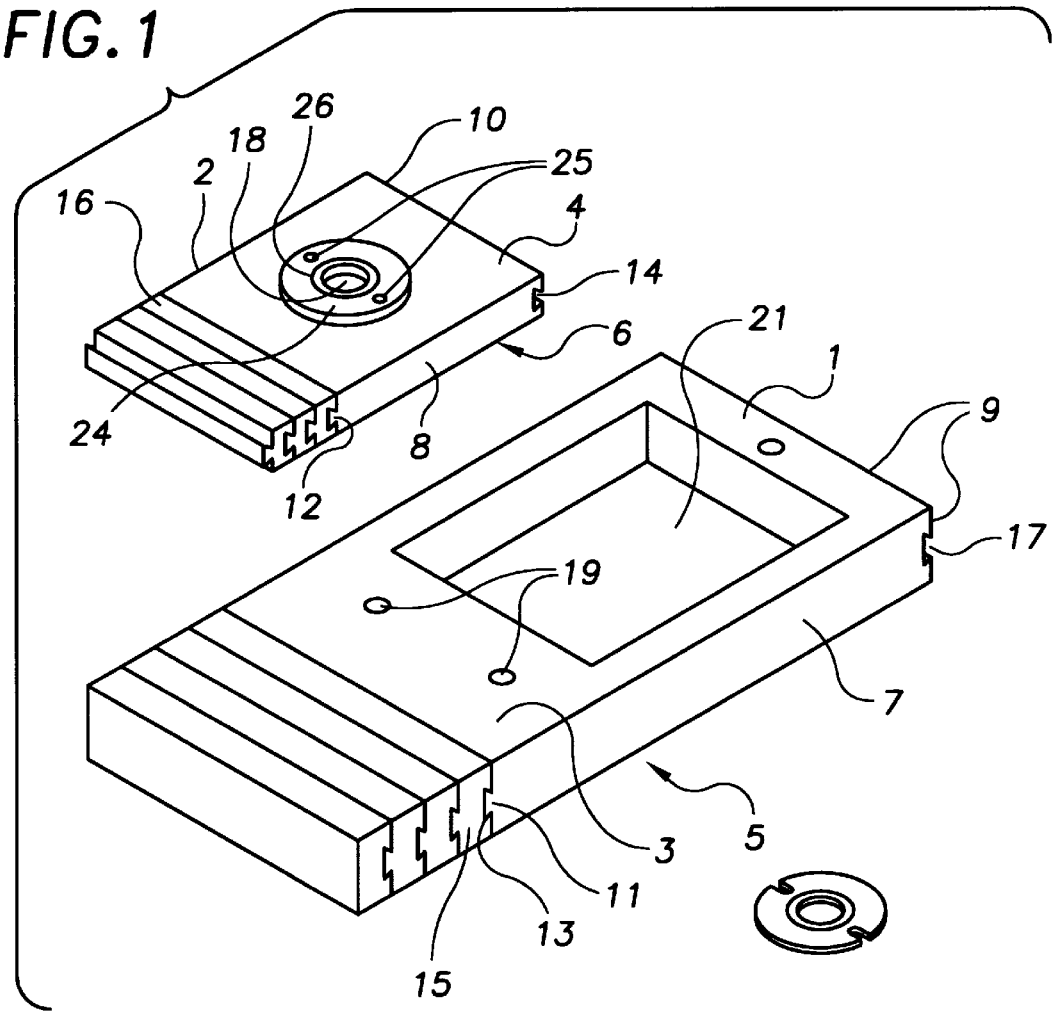
FIG. 1 is a perspective view of the inventive device.
Figure 2:
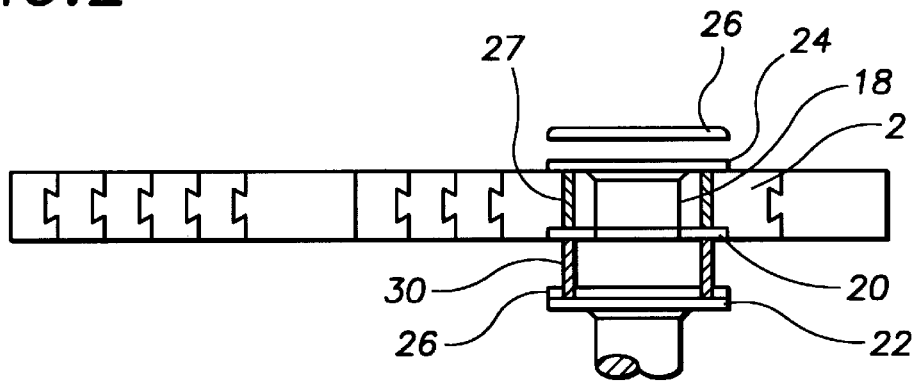
FIG. 2 is a side cross-sectional view of the inventive device.

Referring now to FIGS. 1 and 2, the present invention relates to a platform assembly for elevating a conventional toilet. The device comprises a base platform section 1 having an upper surface 3, a lower surface 5, a pair of opposing side walls 7 and a pair of opposing end walls 9 therebetween. A first end wall includes a tongue 11 dimensioned to be received within a groove 13 on any one of a plurality of platform extensions 15. The opposing end includes a groove 17 similar to those on the extensions allowing the extensions to be attached to either end to vary the length of the base platform section. Accordingly, the base platform section may be configured to fit various size toilets. The base platform section also includes a plurality of apertures 19 for receiving bolts or similar fasteners to secure the section to the bathroom floor.

The base platform section also includes a substantially rectangular or square opening 21 for receiving an insert platform section 2. The insert platform section likewise includes an upper surface 4, a lower surface 6, a pair of opposing side walls 8 and a pair of opposing end walls 10 therebetween. As with the base plate platform section, the insert section includes a tongue 12 on a first end wall and a groove 14 on the opposing end wall allowing one or more extensions 16 to be attached to either end. Extending from the upper surface to the lower surface of the insert platform is a bore 18 for establishing fluid communication between the toilet and a sewer line when the toilet is mounted on the platform assembly. The lower surface of the insert section includes an annular recess 20 circumferentially surrounding the lower end of the bore for receiving a first flange 22 mounted to the bathroom floor. On the upper surface of the insert section and surrounding the upper end of the bore is a second flange 24 having a similar configuration as the first flange. The flanges include a wax ring 26 to provide a liquid tight seal between the toilet outlet and the insert platform section as well as the insert platform section and the floor. The second flange also includes a pair of diametrically opposed apertures 25 in communication with passageways 27 within the insert section for receiving bolts 30 normally used to secure the base of the conventional toilet to the bathroom floor.

To use the above described device, the base platform section is adjusted to a desired dimension by adding or removing the extensions depending upon the size of the toilet base. The base platform section is secured to the bathroom floor with bolts. The insert section is likewise adjusted to a desired length and is placed within the opening on the base platform section. The toilet is then placed on the upper surface of the platform sections and is bolted to the insert section and floor.

From the above description, it is now apparent that the present invention provides a platform assembly for elevating a toilet that is configurable to fit most toilets regardless of the size of the toilet or the orientation and positioning of the outlet piping.

The platform sections of the present invention may be constructed with any suitable material such as metal or plastic. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A platform assembly for elevating a toilet comprising:

a base platform section having an upper surface, a lower surface and an opening;

a plurality of extensions removably attachable to said base platform section to selectively vary the size thereof;

an insert platform section removably received within the opening on the base platform section, the insert section including an upper surface, a lower surface and a plurality of extensions removably attachable thereto allowing the size of the insert section to be selectively varied, the insert section further including a bore extending from the upper surface to the lower surface for establishing fluid communication between the toilet and an existing sewer line.

2. A device according to claim 1 wherein said insert section further includes an annular recess on the lower surface thereof and surrounding a lower end of said bore for receiving a first flange mounted to a bathroom floor.

3. A device according to claim 2 further comprising a second flange mounted on the upper surface of said insert section, said flange including a pair of diametrically opposed apertures registering with a pair of passageways within said insert section, said passageways and apertures for receiving bolts extending from a floor to secure said toilet to said platform assembly.

4. A device according to claim 3 wherein each of said flanges include a wax ring thereon for providing a liquid tight seal.

5. A device according to claim 1 wherein said base platform section includes a plurality of apertures for receiving a fastener means to secure said base platform section to the floor.

6. A device according to claim 1 wherein each extension includes a tongue and groove for selectively engaging a tongue and groove on said platform sections.

* * * * *